US009016261B2

(12) United States Patent
Anetsberger et al.

(10) Patent No.: US 9,016,261 B2
(45) Date of Patent: Apr. 28, 2015

(54) PRESSURE RELIEF DEVICE OF AN INJECTION SYSTEM AND METHOD FOR PRESSURE RELIEF OF AN INJECTION SYSTEM

(75) Inventors: Daniel Anetsberger, Teugn (DE); Reinhard Barth, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 794 days.

(21) Appl. No.: 13/257,825

(22) PCT Filed: Mar. 16, 2010

(86) PCT No.: PCT/EP2010/053328

§ 371 (c)(1),
(2), (4) Date: Oct. 25, 2011

(87) PCT Pub. No.: WO2010/106037

PCT Pub. Date: Sep. 23, 2010

(65) Prior Publication Data

US 2012/0067328 A1 Mar. 22, 2012

(30) Foreign Application Priority Data

Mar. 20, 2009 (DE) ..... 10 2009 014 072

(51) Int. Cl.
*F02M 69/54* (2006.01)
*F02M 37/00* (2006.01)
(Continued)

(52) U.S. Cl.
CPC ..... *F02M 63/0225* (2013.01); *F02M 55/007* (2013.01); *F02M 55/02* (2013.01); *F02M 63/0245* (2013.01)

(58) Field of Classification Search
CPC ..... F02M 69/18; F02M 69/26; F02M 69/52; F02M 69/54; F02M 2200/18; F02D 17/04
USPC ..... 123/198 D, 198 DB, 456–460, 445, 447, 123/510, 511
See application file for complete search history.

(56) References Cited

U.S. PATENT DOCUMENTS 4,187,817 A * 2/1980 Wilson et al. ..... 123/463
4,649,884 A * 3/1987 Tuckey ..... 123/457
(Continued)

FOREIGN PATENT DOCUMENTS

DE 19630938 A1 2/1998 ..... F02M 59/38
DE 19822671 11/1999 ..... F02M 55/00
(Continued)

OTHER PUBLICATIONS

International PCT Search Report and Written Opinion, PCT/EP2010/053328, 16 pages.
(Continued)

*Primary Examiner* — Hieu T Vo
*Assistant Examiner* — Sherman Manley
(74) *Attorney, Agent, or Firm* — King & Spalding L.L.P.

(57) ABSTRACT

For a pressure relief device of an injection system of an internal combustion engine, for an injection system of an internal combustion engine having a pressure relief device and in a pressure relief method of an injection system of an internal combustion engine, a defined fuel pressure of the injection system is reduced to a defined fuel residual pressure upon exceeding a pressure limit above a defined fuel pressure, permitting emergency operation of the internal combustion engine.

10 Claims, 3 Drawing Sheets

(51) Int. Cl.

| | |
|---|---|
| ***F02M 63/02*** | (2006.01) |
| ***F02M 55/00*** | (2006.01) |
| ***F02M 55/02*** | (2006.01) |

(56) References Cited

U.S. PATENT DOCUMENTS

| | | | | |
|---|---|---|---|---|
| 5,329,899 | A * | 7/1994 | Sawert et al. | 123/198 DB |
| 5,577,479 | A * | 11/1996 | Popp | 123/458 |
| 5,692,476 | A * | 12/1997 | Egler et al. | 123/456 |
| 6,241,212 | B1 * | 6/2001 | Takahashi et al. | 251/44 |
| 6,446,616 | B1 * | 9/2002 | Kabat et al. | 123/527 |
| 6,755,625 | B2 * | 6/2004 | Breeden | 417/298 |
| 6,918,379 | B2 | 7/2005 | Reischl et al. | |
| 7,059,302 | B2 * | 6/2006 | Lemoure | 123/446 |
| 7,513,240 | B2 * | 4/2009 | Usui et al. | 123/467 |
| 7,779,816 | B2 * | 8/2010 | Dolker | 123/456 |
| 7,784,447 | B2 * | 8/2010 | Ricco et al. | 123/510 |
| 8,393,881 | B2 * | 3/2013 | Usui et al. | 417/540 |
| 2002/0157529 | A1 * | 10/2002 | Kariya et al. | 91/461 |
| 2004/0161645 | A1 * | 8/2004 | Poschmann et al. | 429/17 |
| 2004/0200456 | A1 | 10/2004 | Eser et al. | |
| 2009/0013966 | A1 * | 1/2009 | Serra et al. | 123/458 |
| 2009/0252621 | A1 | 10/2009 | Siegel et al. | |

FOREIGN PATENT DOCUMENTS

| | | | | |
|---|---|---|---|---|
| DE | 10155247 | A1 | 5/2003 | F02D 41/22 |
| DE | 102008036819 | A1 * | 2/2010 | F02M 63/02 |
| EP | 0678668 | A2 | 10/1995 | F02M 55/02 |
| EP | 1411238 | | 4/2004 | F02M 63/02 |
| GB | 2041449 | A | 9/1980 | F16K 17/16 |
| WO | 03/031788 | A1 | 4/2003 | F02D 41/22 |
| WO | 2007/122127 | A1 | 11/2007 | F02M 59/46 |

OTHER PUBLICATIONS

Bosch, et al., "Electronic Accumulator Injection Common Rail", Diesel-Speichereinspritzystem Common Rail, Edition 98/99, pp. 1-49, XP002209528.

* cited by examiner

PRESSURE RELIEF DEVICE OF AN INJECTION SYSTEM AND METHOD FOR PRESSURE RELIEF OF AN INJECTION SYSTEM

CROSS-REFERENCE TO RELATED APPLICATIONS

This application is a U.S. National Stage Application of International Application No. PCT/EP2010/053328 filed Mar. 16, 2010, which designates the United States of America, and claims priority to German Application No. 10 2009 014 072.7 filed Mar. 20, 2009, the contents of which are hereby incorporated by reference in their entirety.

TECHNICAL FIELD

The invention relates to a pressure relief device of an injection system of an internal combustion engine, to an injection system of an internal combustion engine having a pressure relief device according to the invention, and to a pressure relief method for an injection system of an internal combustion engine.

BACKGROUND

An injection system of an internal combustion engine usually supplies a plurality of injectors of an internal combustion engine with fuel from a fuel tank. By way of example, the construction of the injection system is explained using a common rail injection system of a diesel engine. However, other injection systems and other fuels can also be used.

In a common rail injection system, fuel is sucked out of the fuel tank with the aid of a fuel delivery pump. The fuel delivery pump increases the fuel pressure to approximately from 2 to 5 bar and is connected to a high pressure pump. The fuel is guided from the high pressure pump via a fuel distributor rail (common rail) to the plurality of injectors. The fuel pressure between the high pressure pump and the plurality of injectors is over 1500 bar and is generally called the high pressure region of the injection system. Excess fuel is fed from the plurality of injectors via a return line to the fuel tank again.

The components which are present in the high pressure region, such as the fuel lines and the fuel distributor rail, are designed for operation at a defined fuel pressure. If this defined fuel pressure is exceeded, partial or complete destruction or damage of the components in the high pressure region can occur. In order to prevent the partial or complete destruction or damage, the high pressure region is equipped with a pressure relief device. The pressure relief device in the high pressure region allows the defined fuel pressure in the injection system to be lowered to the defined fuel pressure if a pressure limiting value is exceeded.

EP 0 678 668 B1 has disclosed a fuel injection device for internal combustion engines having a pressure relief device. The pressure relief device comprises a pressure limiting valve which additionally has a return line with a rupture disk inserted in the latter. If a maximum pressure is exceeded, the rupture disk releases an enlarged outflow cross section in the return line. As a result, the pressure limiting valve is protected from excessively high pressure loading.

During operation, the pressure limiting valve is actuated if a pressure drop cannot be achieved via regulation of the high pressure pump. As a result of the actuation, fuel flows out of the injection system through the pressure limiting valve into the return line. When the pressure has dropped again, the pressure limiting valve is closed. If the pressure exceeds a pressure limiting value during opening of the pressure relief valve, the rupture disk is destroyed and an enlarged outflow cross section is released in the return line. In this way, the pressure is lowered again to the defined fuel pressure. As soon as the rupture disk has been destroyed, the enlarged outflow cross section of the return line is used during every actuation of the pressure relief valve, however.

One disadvantage of this system is that the defined pressure can continue to be exceeded after the destruction of the rupture disk. As a result, this can lead to the damage of the components and to the impairment of the injection system.

Furthermore, it is disadvantageous that more rapid pressure changes occur in the fuel injection system on account of the enlarged outflow cross section, which requires precise control of the pressure limiting valve.

SUMMARY

According to various embodiments, a pressure relief device of an injection system can be simplified and optimized in comparison to conventional systems.

According to an embodiment, by way of a pressure relief device of an injection system of an internal combustion engine, if a pressure limiting value above a defined fuel pressure of the injection system is exceeded, the defined fuel pressure can be reduced to a defined residual fuel pressure which permits emergency operation of the internal combustion engine.

According to a further embodiment, the device may have a throttle and a rupture disk which is connected behind the throttle.

According to another embodiment, an injection system of an internal combustion engine may comprise: a pump, by way of which a defined fuel pressure can be generated in the injection system, a fuel distributor rail, to which a plurality of injectors are connected and which is connected to the pump, and a pressure relief device which is arranged between the pump and the plurality of injectors and by way of which, if a pressure limiting value above the defined fuel pressure is exceeded, the defined fuel pressure can be reduced to a defined residual fuel pressure which permits emergency operation of the internal combustion engine.

According to a further embodiment of the injection system, the system can be a common rail injection system of a diesel engine. According to a further embodiment of the injection system, the pump can be a high pressure pump of the common rail injection system. According to a further embodiment of the injection system, the pressure limiting value which can be realized by way of the pressure relief device may lie 200 bar above the defined fuel pressure. According to a further embodiment of the injection system, a defined residual fuel pressure of 500 bar can be realized by way of the pressure relief device. According to a further embodiment of the injection system, the pressure relief device may have a throttle with a rupture disk which is connected behind it.

According to yet another embodiment, a pressure relief method for an injection system of an internal combustion engine, which pressure relief method may have the following steps:—arranging of a pressure relief device between a pump and a plurality of injectors,—reducing of a defined fuel pressure of the injection system, if a pressure limiting value above the defined fuel pressure is exceeded, to a defined residual fuel pressure which permits emergency operation of the internal combustion engine.

According to a further embodiment of the method, the pressure limiting value may lie 200 bar above the defined fuel pressure. According to a further embodiment of the method, the residual fuel pressure can be 500 bar.

BRIEF DESCRIPTION OF THE DRAWINGS

In the following text, the present invention will be described with reference to the accompanying drawings using an embodiment. This embodiment comprises an injection system of an internal combustion engine, in which injection system the pressure relief device is installed.

In the drawings.

DETAILED DESCRIPTION

Figure 1:
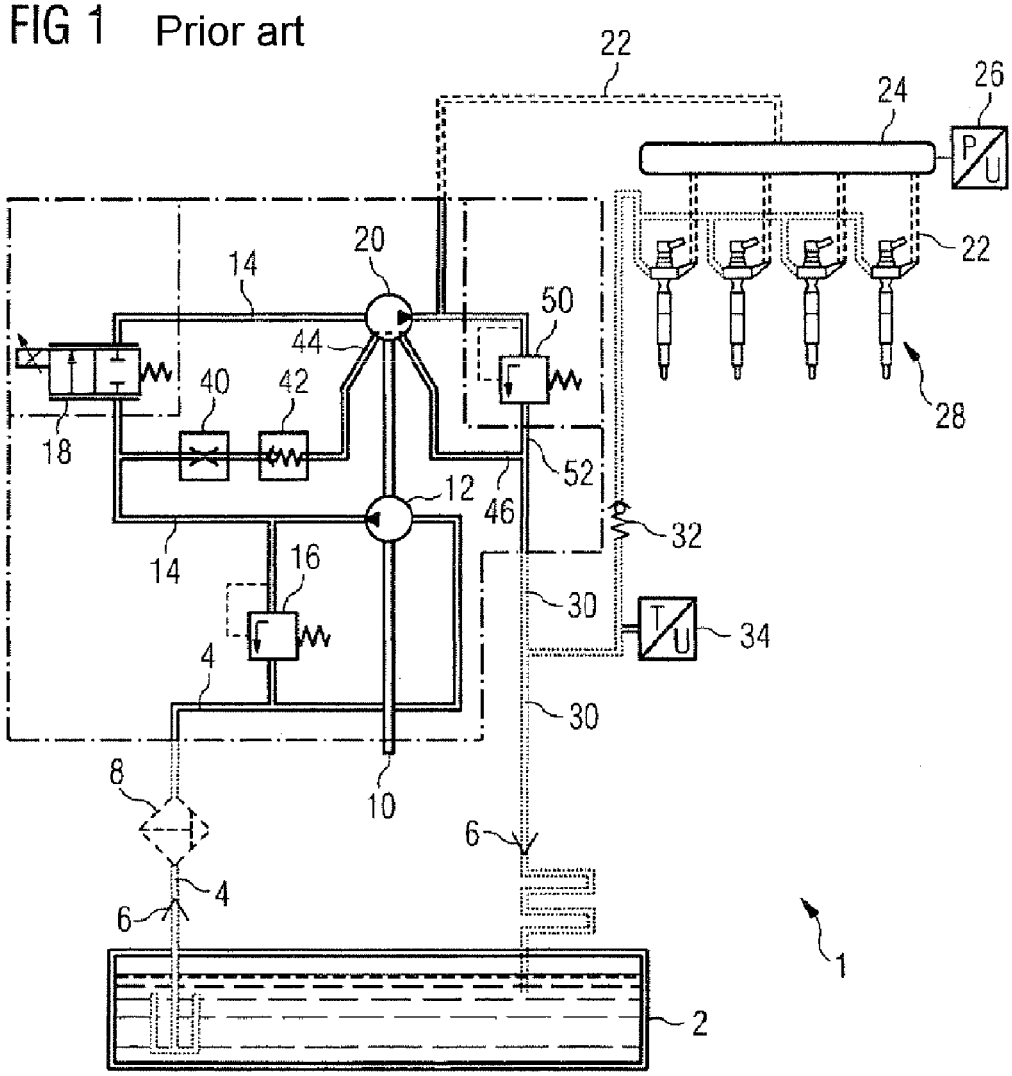
FIG 1 Prior art
FIG. 1 shows a diagrammatic illustration of a conventional injection system.

By way of the pressure relief device according to various embodiments of an injection system of an internal combustion engine, if a pressure limiting value above a defined fuel pressure of the injection system is exceeded, the defined fuel pressure can be reduced to a defined residual fuel pressure which permits emergency operation of the internal combustion engine. The fuel pressure in an injection system is reduced if a pressure limiting value is exceeded. The pressure limiting value lies above a defined fuel pressure. The defined fuel pressure corresponds, for example, to a maximum fuel pressure which occurs during normal operation of the internal combustion engine. After the exceeding, the defined fuel pressure is reduced to a defined residual fuel pressure. The residual fuel pressure permits emergency operation of the internal combustion engine. Emergency operation means, for example, that a driver of a motor vehicle is still capable of driving to a nearest repair shop or out of a dangerous region.

It is one advantage of the various embodiments that the fuel pressure in the injection system is lowered to the residual fuel pressure in a long-lasting manner. As a result, renewed exceeding of the pressure limiting value is prevented. As a result, the components of the injection system cannot be exposed repeatedly to the excess pressure. Damage and destruction of the components can correspondingly be avoided.

It is a further advantage of the various embodiments that a residual fuel pressure is maintained which permits emergency operation of the internal combustion engine. Further operation of the internal combustion engine can be ensured on the basis of this residual fuel pressure. A complete failure of the internal combustion engine on account of the pressure limiting value being exceeded cannot therefore occur. Nevertheless, the exceeding can be determined by a user, such as a driver of a motor vehicle which is equipped with the pressure relief device, since only emergency operation can still be realized with the internal combustion engine. According to one embodiment, the pressure relief device has a throttle and a rupture disk which is connected behind the throttle. The pressure limiting value is defined with the aid of the rupture disk. If this pressure limiting value is exceeded, the rupture disk is destroyed partially or completely. In order to prevent the fuel from flowing out in an unimpeded manner, a throttle is connected in front of the rupture disk. A defined residual fuel pressure which permits emergency operation of the internal combustion engine can be maintained with the aid of the throttle.

As an alternative to the use of the throttle with the rupture disk connected behind it, a controlled valve can be used in combination with a pressure sensor, which are connected to a control unit. The pressure limiting value is stored in the control unit. If, via the pressure sensor, the control unit detects a fuel pressure which lies above the stored pressure limiting value, the valve is actuated and opened. If the fuel pressure which is detected by the pressure sensor corresponds to a residual fuel pressure which is stored in the control unit, the valve is actuated and closed to such an extent that the residual fuel pressure is maintained. This can take place, for example, on the basis of a repeating comparison between a defined residual fuel pressure and a detected fuel pressure in the control unit.

An injection system according to various embodiments of an internal combustion engine comprises: a pump, by way of which a defined fuel pressure can be generated in the injection system, a fuel distributor rail, to which a plurality of injectors are connected and which is connected to the pump, and a pressure relief device which is arranged between the pump and the plurality of injectors and by way of which, if a pressure limiting value above the defined fuel pressure is exceeded, the defined fuel pressure can be reduced to a defined residual fuel pressure which permits emergency operation of the internal combustion engine.

The pressure relief device according to various embodiments is arranged between the pump and the plurality of injectors of the internal combustion engine. The defined fuel pressure in the injection system can be generated by way of the pump. For example, the pump is a high pressure pump of a common rail injection system. However, it can also be the pump of a direct gasoline injection system. The maximum defined fuel pressure which can be generated by the pump corresponds, for example, to a stored maximum fuel pressure during normal operation of the internal combustion engine. The plurality of injectors are connected to the fuel distributor rail. The fuel distributor rail is connected to the pump.

The pressure relief device is advantageously arranged at a point of the injection system, at which it is readily accessible and can be serviced during a later arrangement of the injection system in a motor vehicle. These positions can be, for example, a high pressure outlet of the pump or the fuel distributor rail. It is particularly advantageous in relation to the arrangement on the fuel distributor rail if the pressure relief device is arranged on the fuel distributor rail at a spacing from a pressure sensor which is arranged on the fuel distributor rail.

In one embodiment, the injection system is a common rail injection system of a diesel engine. In diesel engines, pressures of up to 2200 bar occur in the high pressure region of the injection system. For this reason, it is particularly important to provide a pressure relief device which prevents a defined fuel pressure beyond a fuel pressure limiting value being exceeded repeatedly. Damage to components of the injection system can therefore be avoided.

Furthermore, it is advantageous if the pump is a high pressure pump of the common rail injection system. In principle, the pressure relief device according to various embodiments can be arranged at any point of the injection system. However, the properties of the pressure relief device in the high pressure region are particularly advantageous, however, as mentioned above.

In a further embodiment, the pressure limiting value which can be realized by way of the pressure relief device lies 200 bar above the defined fuel pressure. In this way, pressure fluctuations of up to 200 bar around the defined fuel pressure are tolerated. This makes it possible that the injection system does not already only permit emergency operation of the internal combustion engine in the case of a small fluctuation of the fuel pressure.

Furthermore, it is advantageous if a defined residual fuel pressure of 500 bar can be realized by way of the pressure relief device. This residual fuel pressure permits emergency operation of the internal combustion engine. Further operation of the internal combustion engine can therefore be ensured.

Furthermore, it is advantageous if the pressure relief device has a throttle with a rupture disk which is connected behind it, as shown above. Instead of the combination of rupture disk and throttle, a controlled valve and a pressure sensor can be used which are connected to a control unit. The advantages of this embodiment have likewise been described further above.

A pressure relief method according to various embodiments for an injection system of an internal combustion engine has the following steps: arranging of a pressure relief device between a pump and a plurality of injectors, reducing of a defined fuel pressure of the injection system, if a pressure limiting value above the defined fuel pressure is exceeded, to a defined residual fuel pressure which permits emergency operation of the internal combustion engine.

During operation, the pressure relief method according to various embodiments reduces the fuel pressure of the injection system if the pressure limiting value is exceeded. This pressure limiting value lies above the defined fuel pressure. A reduction can take place both on the basis of a regulation operation and on the basis of an exclusively mechanical device. For example, a rupture disk represents an exclusively mechanical device of this type. In the context of a regulation operation, a controlled valve and a pressure sensor are required which are connected to a control unit. If the control unit determines the exceeding of the defined fuel pressure on the basis of the fuel pressure which is detected by the pressure sensor, the valve is actuated and opened. The valve is actuated again when the defined residual fuel pressure has been reached. During further operation, the defined residual fuel pressure is maintained on account of a corresponding actuation of the valve.

A reduction is carried out to the residual fuel pressure which permits exclusively emergency operation of the internal combustion engine. If the rupture disk is used, this can be realized via a throttle which is connected in front of it. In the regulation operation, a check of the fuel pressure which is detected by the pressure sensor and a comparison of this fuel pressure with the defined residual fuel pressure are necessary. This can take place, for example, in the control unit.

The pressure limiting value advantageously lies 200 bar above the defined fuel pressure. In this way, fluctuations around the defined fuel pressure of 200 bar can be tolerated, as described above.

Furthermore, it is advantageous that the residual fuel pressure is 500 bar. In this way, emergency operation of the internal combustion engine is ensured.

FIG. 1 shows a pressure relief device for an injection system according to the prior art. The injection system 1 is a common rail injection system 1 of a diesel engine. However, the pressure relief device and the pressure relief method according to various embodiments can also be used in other injection systems, such as in an injection system of a direct injection gasoline engine. In addition, other fuels than diesel fuel can be used.

With reference to FIG. 1, the injection system 1 has a fuel tank 2. The fuel tank 2 is connected via a delivery line 4 to a fuel filter 8 and a fuel delivery pump 12. The flow direction of the fuel is shown by an arrow 6. The fuel delivery pump 12 sucks the fuel out of the fuel tank 2 through the delivery line 4 via the fuel filter 8. Both the fuel delivery pump 12 and a high pressure pump 20 which is present in the injection system are driven via a drive shaft 10.

The fuel leaves the fuel delivery pump 12 through a low pressure line 14 at an increased fuel pressure in comparison with the previous state of from approximately 2.5 to approximately 5 bar. A pressure control valve 16 which connects the low pressure line 14 to the delivery line 4 is installed into the low pressure line 14.

The fuel is guided from the fuel delivery pump 12 through the low pressure line 14 via an electronic regulating valve 18 to a high pressure pump 20. The electronic regulating valve 18 regulates the inflow quantity to the high pressure pump 20. The high pressure pump 20 increases the pressure in the injection system to over 1500 bar, in particular to over 2000 bar. The region between the fuel delivery pump 12 and the high pressure pump 20 is generally called the low pressure region.

A high pressure line 22 guides the fuel which is pressurized in this way to a fuel distributor rail 24. The fuel distributor rail 24 has a high pressure sensor 26. Furthermore, a plurality of injectors 28 are connected to the fuel distributor rail 24 with the aid of the high pressure line 22. Four injectors 28 are advantageously connected to the fuel distributor rail 24. This above-described region between the high pressure pump 20 and the injectors 28 is generally called a high pressure region.

The injectors 28 are connected to a return line 30 which guides excess fuel back into the fuel tank 2. A valve 32 and a temperature sensor 34 are arranged in the return line 30 between the injectors 28 and the fuel tank 2.

The low pressure region of the injection system between the fuel delivery pump 12 and the high pressure pump 20 has a safety device which brings about pressure relief and a return of fuel to the fuel tank 2. The safety device has a throttle 40 and a spring-loaded valve 42. The spring-loaded valve 42 is connected behind the throttle 40. A return line 44 connects the spring valve 42 via the high pressure pump 20 and a further return line 46 to the return line 30 of the injectors 28 and, as a result, to the fuel tank 2.

Pressure relief of the high pressure region of the injection system between the high pressure pump 20 and the plurality of injectors 28 is brought about via a spring-loaded pressure limiting valve 50. This is connected via a return line 52 of the pressure limiting valve 50 to the return line 30 of the injectors 28 and therefore to the fuel tank 2. On account of the pressures which occur in the high pressure region, a safety device which is different from the low pressure region is required here.

In the following text, the method of operation of the spring-loaded pressure limiting valve 50 will be explained. In the injection system, the fuel pressure rises above a defined fuel pressure, for example above 1600 bar. If the fuel pressure exceeds the pressure limiting value of the pressure limiting valve 50 of, for example, 1800 bar, the pressure limiting valve 50 opens. Fuel can therefore flow out through the line 52. If the fuel pressure drops to the above defined fuel pressure of 1600 bar, the valve closes again.

On the basis of this method of operation, it is possible to reach the pressure limiting value multiple times. This can lead to damage or to the destruction of the components which are present in the high pressure region. Defective components of the high pressure region have a negative effect on the injection behavior of the internal combustion engine.

Figure 2:
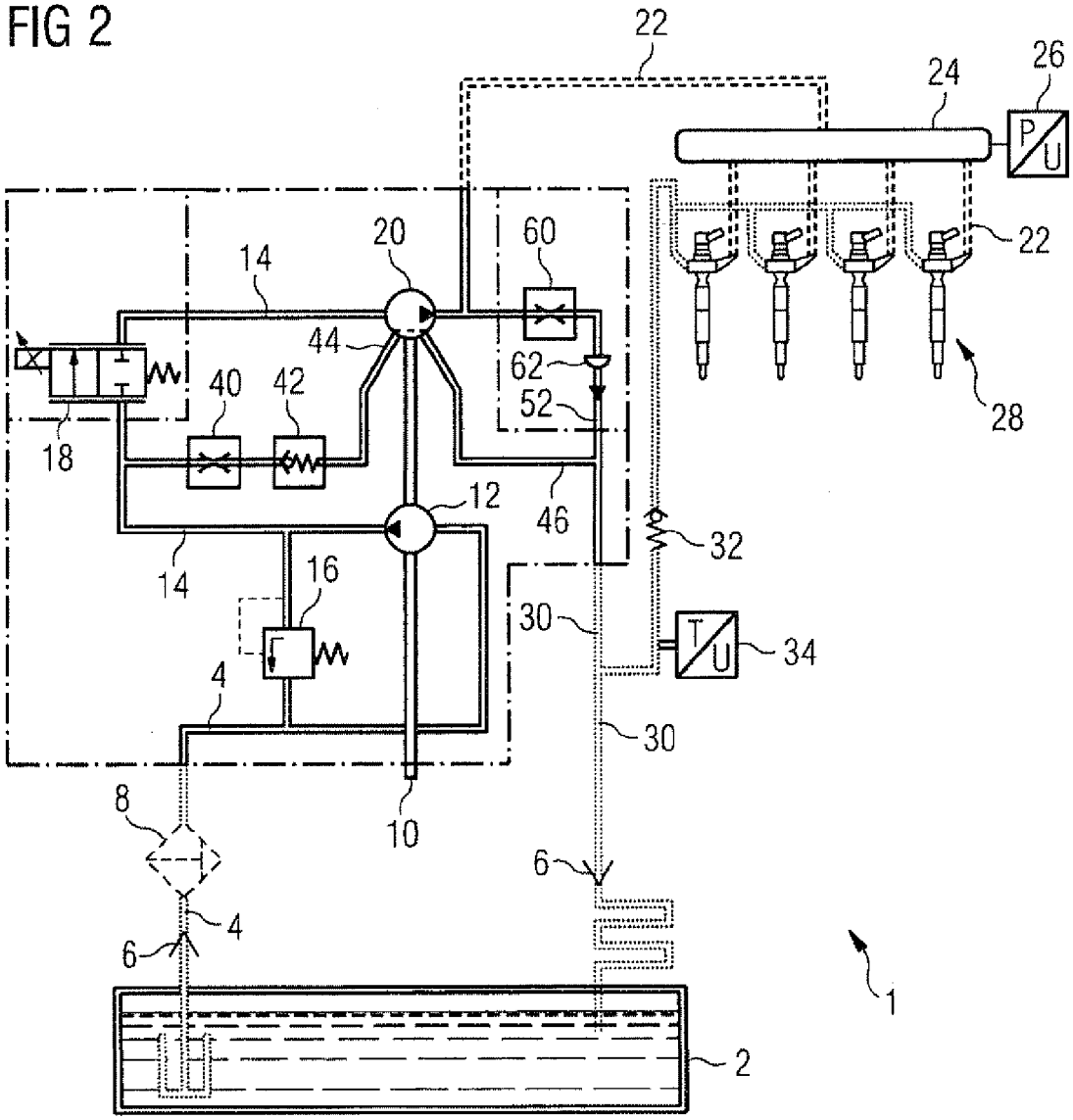
FIG. 2 shows a diagrammatic illustration of the pressure relief device according to various embodiments which is installed in an injection system.
Figure 3:
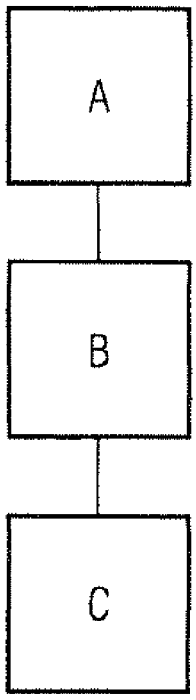
FIG. 3 shows a flow chart of a pressure relief method according to various embodiments.

FIG. 2 shows an injection system having a pressure relief device according to various embodiments. Identical components are labeled by identical designations. According to one embodiment, instead of the spring-loaded pressure limiting valve 50, a throttle 60 with a rupture disk 62 connected behind it is used as pressure relief device. This pressure relief device is advantageously arranged at a readily accessible point of the injection system, such as adjacent to a high pressure outlet of the high pressure pump 20 or on the fuel distributor rail 24. Simple replacement of the rupture disk can therefore be realized. With reference to FIG. 3, step A corresponds to arranging the pressure relief device between the pump 20 and the plurality of injectors 28.

The method of operation of the pressure relief device according to various embodiments is described in the following text and is shown in FIG. 3 by steps B and C. If the defined fuel pressure in the injection system 1 rises above the pressure limiting value, the rupture disk 62 is destroyed partially or completely. Step B in FIG. 3 represents the exceeding of the pressure limiting value. The return line 52 is opened as a result. In order to prevent the fuel pressure in the injection system 1 dropping to atmospheric pressure as a result, the throttle 60 is connected in front of the rupture disk 62. A residual pressure in the fuel injection system 1 can be maintained with the aid of the throttle 60. The reduction of the defined fuel pressure to the defined residual fuel pressure which follows step B is shown in FIG. 3 by step C. The residual pressure is advantageously 500 bar. This residual fuel pressure permits emergency operation of the internal combustion engine.

One advantage of this pressure relief device is that the high pressure region is not exposed to a multiplicity of impermissible, high fuel pressures. Damage or destruction of components in the high pressure region can thus be avoided. If the injection system according to various embodiments is used in a motor vehicle, it is discernible for a driver on account of the emergency running of the internal combustion engine that there was an excessively high fuel pressure. Furthermore, a vehicle having the pressure relief device according to various embodiments can still be driven to the next repair shop or out of a dangerous region in this way.

Instead of the throttle 60 with the rupture disk 62 connected behind it, a controlled valve (not shown) and a high pressure sensor 26 can be used which are connected to a control unit (not shown). During operation, exceeding of the pressure limiting value is determined by the control unit by the comparison with the fuel pressure which is detected by the high pressure sensor. The valve is thereupon actuated and opened until the fuel pressure which is detected by the high pressure sensor corresponds to the residual fuel pressure which is stored in the control unit. This residual fuel pressure is maintained on the basis of a repeated comparison between the stored residual fuel pressure and the detected fuel pressure.

The invention claimed is:

1. A pressure relief device of an injection system of an internal combustion engine, wherein the pressure relief device is configured, if a fuel pressure present in the injection system exceeds a pressure limiting value defined by the pressure relief device, to reduce the fuel pressure to a defined residual fuel pressure which permits emergency operation of the internal combustion engine and wherein the pressure relief device has a throttle and a rupture disk connected in series along a return line connected to a fuel tank, with the rupture disk connected downstream of the throttle along the return line.

2. An injection system of an internal combustion engine comprising:

a) a pump, by way of which a defined fuel pressure can be generated in the injection system, b) a fuel distributor rail, to which a plurality of injectors are connected and which is connected to the pump, and c) a pressure relief device which is arranged between the pump and the plurality of injectors and by way of which, if the defined fuel pressure exceeds a pressure limiting value defined by the pressure relief device, the defined fuel pressure is reduced to a defined residual fuel pressure which permits emergency operation of the internal combustion engine;

wherein the injection system is a common rail injection system of a diesel engine and the pump is a high pressure pump;

wherein the pressure relief device has a throttle with a rupture disk connected in series along a return line connected to a fuel tank, with the rupture disk connected downstream of the throttle along the return line.

3. The injection system according to claim 2, wherein the pressure limiting value which can be realized by way of the pressure relief device lies 200 bar above the defined fuel pressure.

4. The injection system according to claim 2, wherein a defined residual fuel pressure of 500 bar can be realized by way of the pressure relief device.

5. An injection system of an internal combustion engine comprising:

a) a pump, by way of which a defined fuel pressure can be generated in the injection system, b) a fuel distributor rail, to which a plurality of injectors are connected and which is connected to the pump, and c) a pressure relief device which is arranged between the pump and the plurality of injectors and by way of which, if the defined fuel pressure exceeds a pressure limiting value defined by the pressure relief device, the defined fuel pressure can be reduced to a defined residual fuel pressure which permits emergency operation of the internal combustion engine, wherein the pressure relief device has a throttle with a rupture disk connected in series along a return line connected to a fuel tank, with the rupture disk connected downstream of the throttle along the return line.

6. A pressure relief method for an injection system of an internal combustion engine, which pressure relief method has the following steps:

a) arranging of a pressure relief device between a pump and a plurality of injectors, wherein the pressure relief device includes a throttle with a rupture disk connected in series along a return line connected to a fuel tank, with the rupture disk connected downstream of the throttle along the return line; and b) reducing of a defined fuel pressure of the injection system, if a fuel pressure present in the injection system exceeds a pressure limiting value defined by the pressure relief device, to a defined residual fuel pressure which permits emergency operation of the internal combustion engine.

7. The pressure relief method according to claim 6, wherein the pressure limiting value lies 200 bar above the defined fuel pressure.

8. The pressure relief method according to claim 6, wherein the residual fuel pressure is 500 bar.

9. The pressure relief method according to claim 6, wherein the injection system is a common rail injection system of a diesel engine.

10. The pressure relief method according to claim 9, wherein the pump is a high pressure pump of the common rail injection system.

* * * * *